US010004329B2

(12) United States Patent
Nourse et al.

(10) Patent No.: US 10,004,329 B2
(45) Date of Patent: Jun. 26, 2018

(54) WORKSTATION WITH CABLE CONTAINMENT

(71) Applicant: Cooper Technologies Company, Houston, TX (US)

(72) Inventors: Brian C. Nourse, Lancaster, MA (US); Robert R. Cormier, Gardner, MA (US)

(73) Assignee: Cooper Technologies Company, Houston, TX (US)

( * ) Notice: Subject to any disclaimer, the term of this patent is extended or adjusted under 35 U.S.C. 154(b) by 0 days. days.

(21) Appl. No.: 15/216,920

(22) Filed: Jul. 22, 2016

(65) Prior Publication Data

US 2018/0020828 A1 Jan. 25, 2018

(51) Int. Cl.

| | |
|---|---|
| ***A47B 81/00*** | (2006.01) |
| ***A47B 97/00*** | (2006.01) |
| ***A47B 21/06*** | (2006.01) |
| ***F16L 3/01*** | (2006.01) |
| ***A47B 21/02*** | (2006.01) |
| ***A47B 87/00*** | (2006.01) |
| ***A47B 83/04*** | (2006.01) |
| ***A47B 83/00*** | (2006.01) |
| ***F16L 3/26*** | (2006.01) |

(52) U.S. Cl.

CPC ..... *A47B 21/06* (2013.01); *A47B 21/02* (2013.01); *A47B 83/001* (2013.01); *A47B 83/045* (2013.01); *A47B 87/002* (2013.01); *F16L 3/01* (2013.01); *F16L 3/26* (2013.01); *A47B 2021/064* (2013.01)

(58) Field of Classification Search

CPC ..... A47B 21/06; A47B 21/02; A47B 21/00; A47B 2021/064; A47B 2021/062; A47B 2021/066; A47B 83/001; A47B 83/045; A47B 2097/003; F16L 3/01; F16L 3/26

USPC ..... 312/223.6

See application file for complete search history.

(56) References Cited

U.S. PATENT DOCUMENTS

| | | | | | |
|---|---|---|---|---|---|
| 1,786,823 | A * | 12/1930 | Klinck | A47B 21/06 312/194 |
| 3,125,387 | A * | 3/1964 | Abrahamson | A47B 13/06 108/92 |
| 3,140,559 | A * | 7/1964 | Grow | A47B 27/06 108/10 |
| 3,273,517 | A * | 9/1966 | Amthor, Jr. | A47B 27/14 108/140 |

(Continued)

*Primary Examiner* — Daniel J Troy
*Assistant Examiner* — Timothy M Ayres
(74) *Attorney, Agent, or Firm* — Senniger Powers LLP

(57) ABSTRACT

A work station includes a cable raceway. The cable raceway includes a basket in an interior of a base assembly, having an open upper end adjacent an access opening, and a bottom end defining openings, the basket configured to receive cables therein. A cover of the cable raceway is movable between a closed position, in which the cover is received in the access opening and covers the open upper end of the basket to inhibit access to the basket through the access opening, and an open position, in which the cover is at least partially outside the access opening to allow access to the basket through the access opening. The work station may have a work platform that is selectively adjustable in height. A portion of a footprint of the work platform may be commensurate with a corresponding portion of a footprint of the base assembly.

20 Claims, 14 Drawing Sheets

(56) References Cited

U.S. PATENT DOCUMENTS 4,827,850 A * 5/1989 Diffrient ..... A47B 1/04 108/50.02
4,948,205 A * 8/1990 Kelley ..... A47B 21/06 108/50.02
5,451,101 A * 9/1995 Ellison ..... A47B 21/06 248/74.2
5,802,988 A * 9/1998 Shields ..... A47B 9/10 108/147
5,853,236 A * 12/1998 Rogers ..... A47B 21/06 312/223.6
5,878,673 A * 3/1999 Kramer ..... A47B 87/002 108/50.02
6,234,812 B1 * 5/2001 Ivers ..... A47B 21/06 362/127
6,286,441 B1 * 9/2001 Burdi ..... A47B 9/00 108/147
6,312,069 B1 * 11/2001 Weng ..... A47B 9/06 108/147
6,817,684 B2 * 11/2004 Cattaneo ..... A47B 21/06 108/50.02
6,848,369 B1 2/2005 King et al.
7,125,088 B2 * 10/2006 Haberman ..... A47B 21/00 108/102
7,412,931 B2 8/2008 Seidl et al.
7,665,255 B2 * 2/2010 Dressendorfer ..... H02G 3/0456 108/50.02
8,109,215 B2 * 2/2012 Kitada ..... A47B 21/00 108/50.02
8,925,469 B2 * 1/2015 Bennie ..... A47B 21/06 108/50.02
8,926,029 B2 * 1/2015 Han ..... F16M 11/046 312/108
8,985,032 B1 3/2015 Johnson
9,220,342 B2 * 12/2015 Byrne ..... A47B 97/00
9,439,507 B2 * 9/2016 Liu ..... A47B 9/04
2005/0231080 A1 * 10/2005 Torrance ..... A47B 21/06 312/223.6
2005/0279257 A1 * 12/2005 Bettinger ..... A47B 21/06 108/50.02
2006/0081157 A1 4/2006 Gayhart et al.
2009/0008512 A1 * 1/2009 Davis ..... E04F 15/0247 248/49
2013/0199420 A1 * 8/2013 Hjelm ..... A47B 21/00 108/20
2014/0096706 A1 * 4/2014 Labrosse ..... A47B 21/02 108/21
2014/0208986 A1 7/2014 DesRoches et al.
2016/0360879 A1 * 12/2016 Kelley ..... A47B 21/02

* cited by examiner

10

WORKSTATION WITH CABLE CONTAINMENT

FIELD

The present disclosure generally relates to a workstation, such as a workstation with a cable containment system for containing and concealing cables associated with electronic devices accessed from the workstation.

BACKGROUND

Workstations can support displays, user input devices, user output devices, and other electronic devices above a tabletop. It is often desirable to contain and conceal the signal and power cables associated with such devices. It may also be desirable to provide selective adjustment of the height of the tabletop so that a user may comfortably work at the workstation in a sitting position or a standing position.

SUMMARY

In one aspect, a height-adjustable work station comprises a base assembly comprising one or more cabinet modules. The base assembly has an upper surface, opposite left and right sides defining a width of the base assembly extending therebetween, and opposite front and rear ends defining a depth of the base assembly therebetween. The upper surface of the base assembly has left, right, front and rear edges at the junctions of the left side, right side, front end and rear end, respectively. A work platform is disposed above the base assembly. The work platform has a lower surface in generally opposing relationship with the upper surface of the base assembly. Opposite left and right sides define a width of the work platform extending therebetween, and opposite front and rear ends define a depth of the work platform therebetween. The lower surface of the work platform has left, right, front and rear edges at the junctions of the left side, right side, front end and rear end, respectively. A lift is operatively connected to the work platform and configured to selectively adjust an elevation of the work platform above the base assembly. The left, right and rear edges of the lower surface of the work platform generally overlie the left, right and rear edges, respectively, of the upper surface of the base assembly. Sizes and shapes of the left, right and rear edges of the lower surface of the work platform generally conform to the sizes and shapes of the left, right and rear edges, respectively, of the upper surface of the base assembly.

In another aspect, a work station comprises a base assembly including sides having upper and lower ends and an upper surface at the upper end of the sides and defining an access opening. The sides and the upper surface define an interior of the base assembly. A cable raceway is secured to the base assembly adjacent the access opening defined by the upper surface of the base assembly. The cable raceway includes a basket disposed in the interior of the base assembly. The basket has an open upper end adjacent the access opening and a bottom end defining a plurality of openings. The basket is configured to receive cables therein. A cover is configured to be movable between a closed position, in which the cover is received in the access opening and covers the open upper end of the basket to inhibit access to the basket through the access opening, and an open position, in which the cover is at least partially outside the access opening to allow access to the basket through the access opening.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
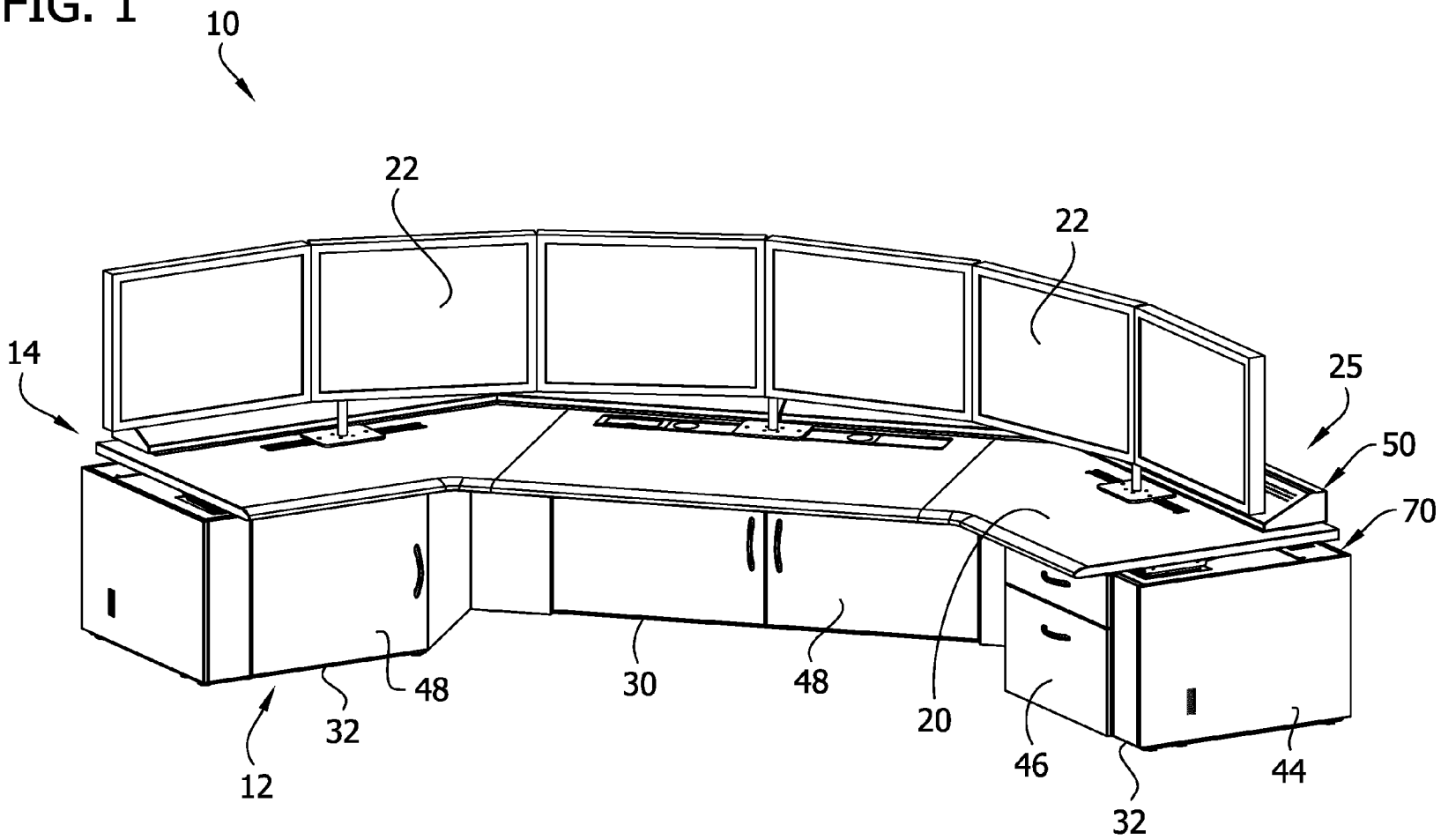
FIG. 1 is a perspective of a workstation in a sitting configuration illustrating displays mounted on a tabletop assembly of the workstation.
Figure 2:
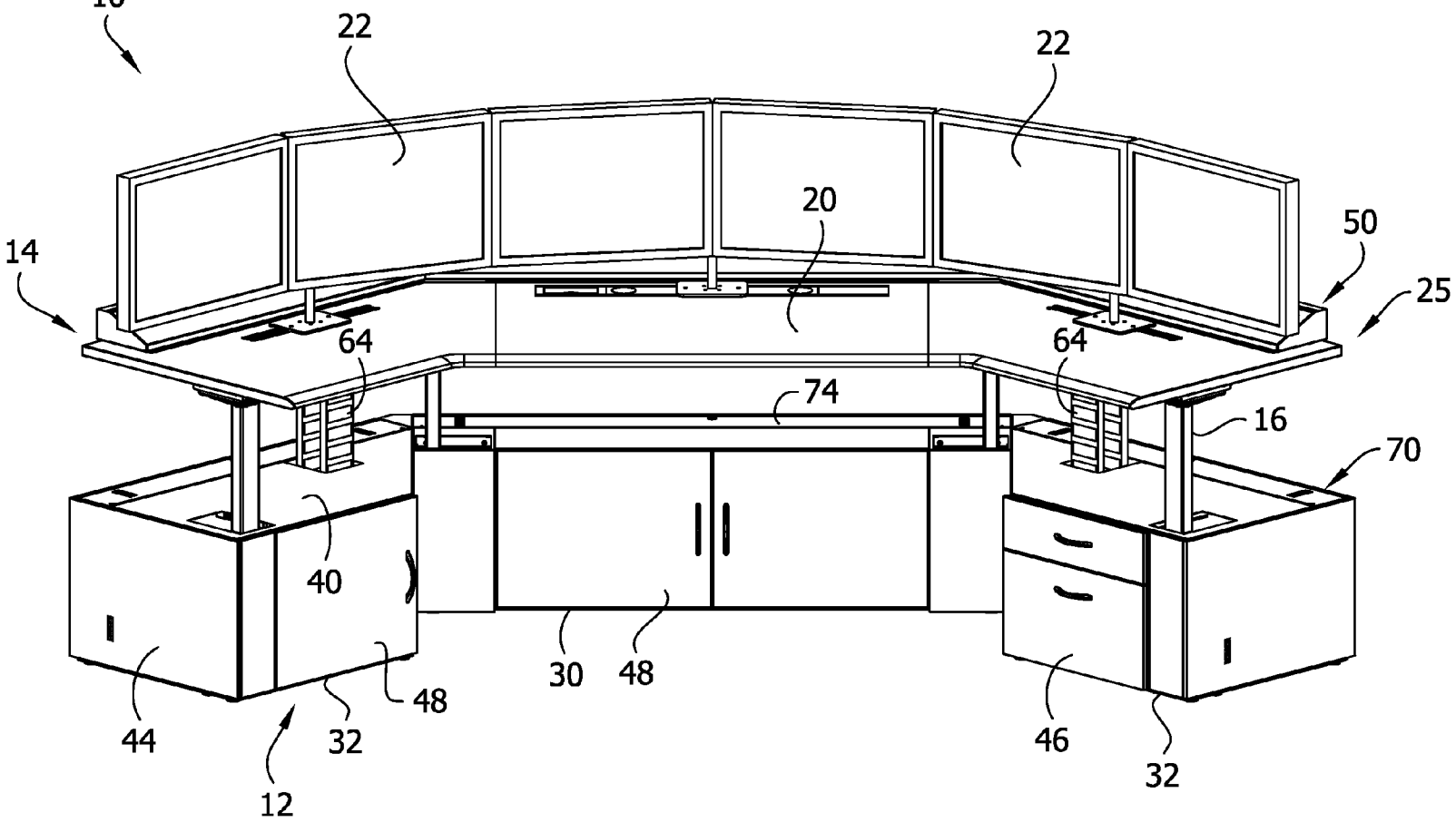
FIG. 2 is a perspective of the workstation in a standing configuration with the tabletop assembly in an elevated position.
Figure 3:
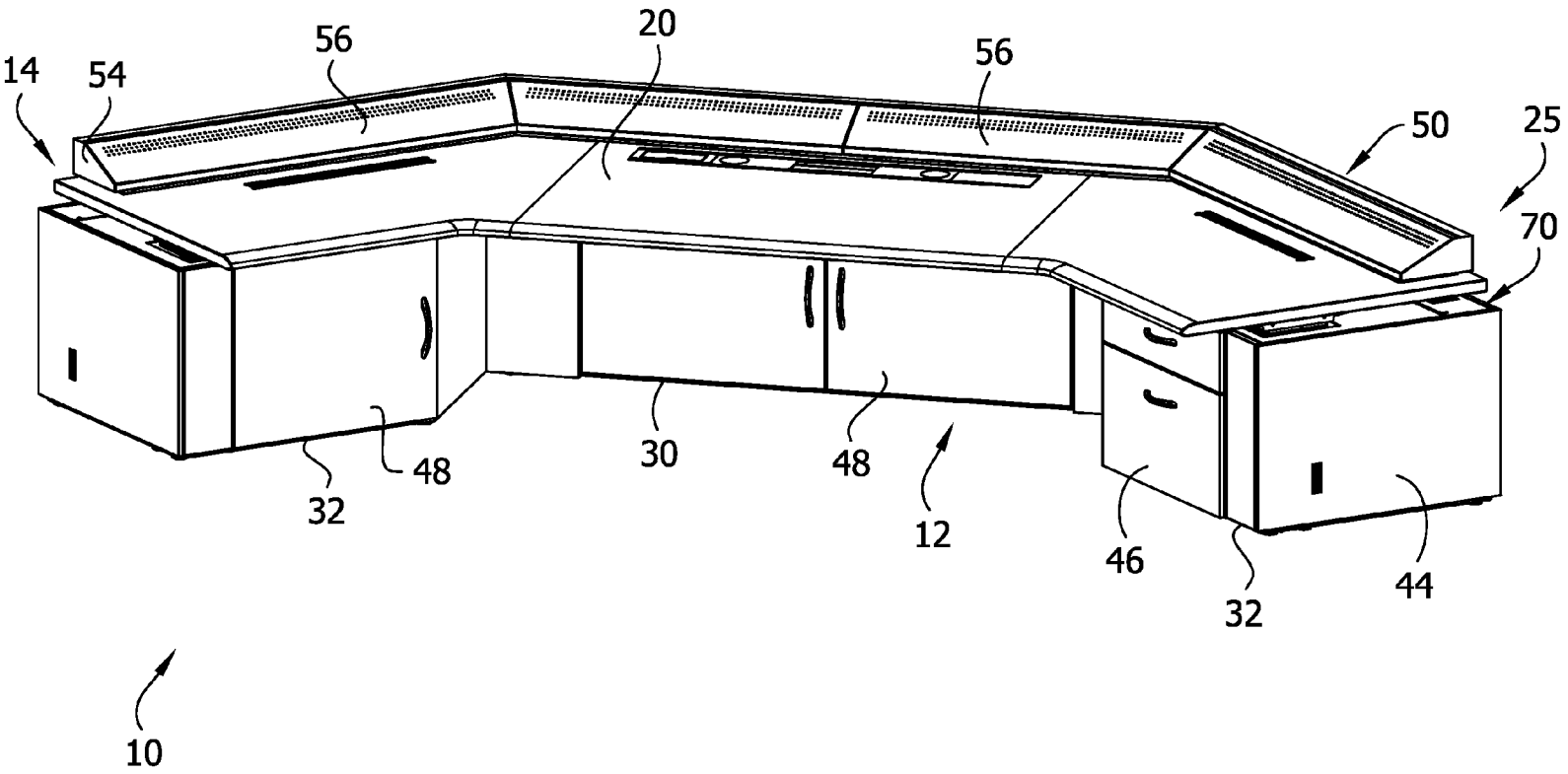
FIG. 3 is a perspective of the workstation in the sitting configuration with the displays removed.
Figure 4:
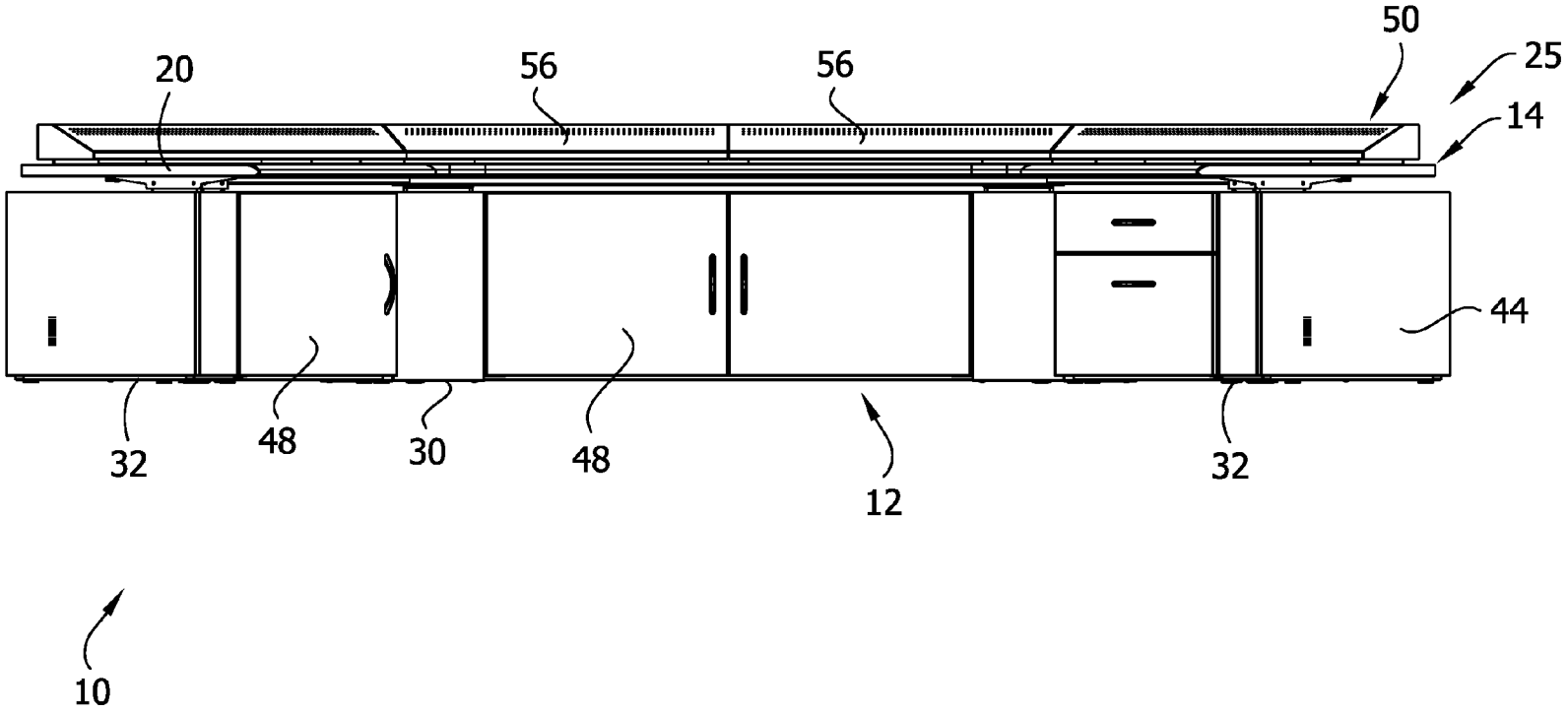
FIG. 4 is a front elevation of the workstation shown in FIG. 3.
Figure 5:
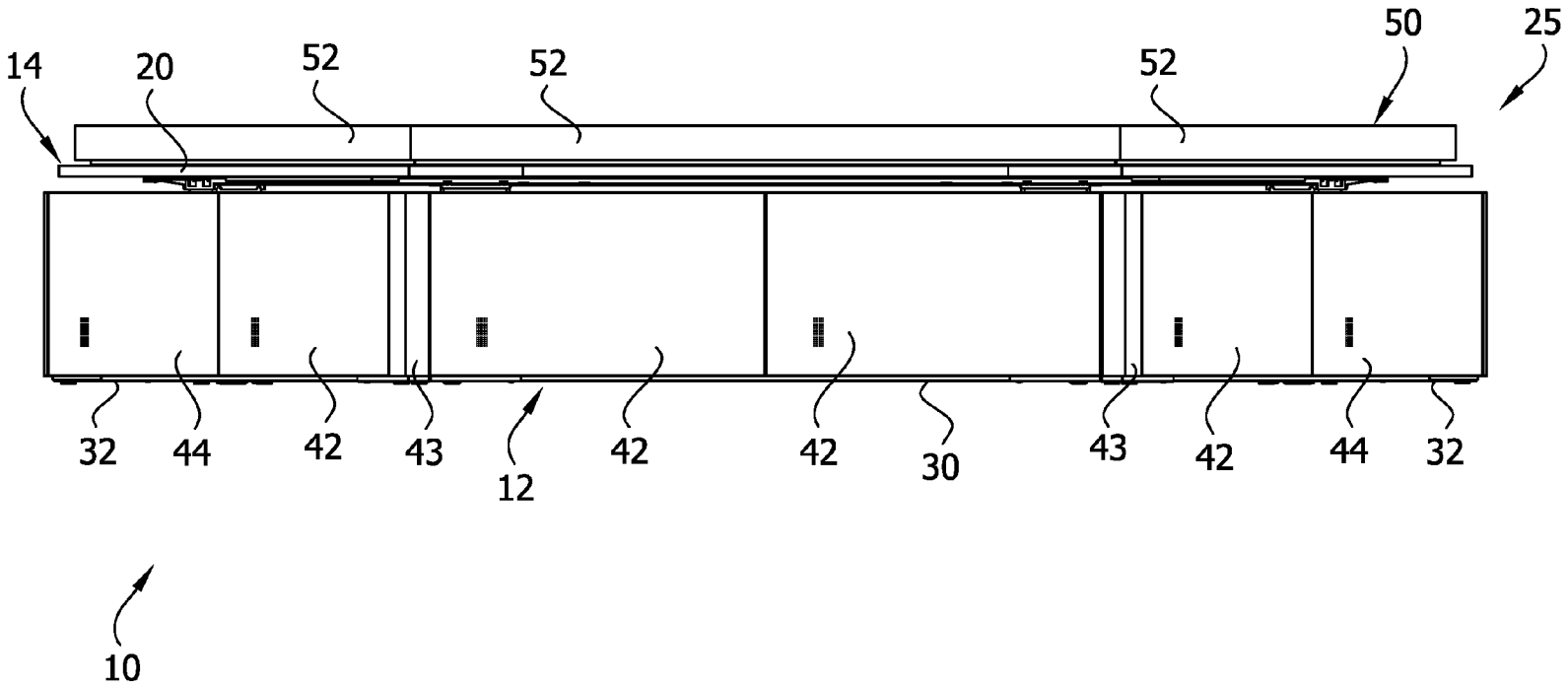
FIG. 5 is a rear elevation of the workstation shown in FIG. 3.

Referring to FIGS. 1-8, one embodiment of a workstation is generally indicated at 10. The workstation 10 includes a modular base assembly, generally indicated at 12, and a tabletop or desktop assembly, generally indicated at 14, mounted on the base assembly. The tabletop assembly 14 is positioned above the base assembly 12 for movement between a sitting position (FIG. 1), i.e., a lowered position, and a standing position (FIG. 2), i.e., an elevated position. More specifically, as shown in FIG. 2, the tabletop assembly 14 is supported on a lift 16 for lifting the tabletop assembly 14 to the standing position and lowering the tabletop assembly to the sitting position. In the sitting position, a work platform 20 of the tabletop 14 is positioned at a height for access by a human user of about normal size seated in a conventional office chair. In the standing position, the work platform 20 is positioned at a height for access by a human user of about normal size who is standing on the floor. The tabletop 14 is positionable to essentially any position between the sitting and standing positions to accommodate users of different sizes and preferences. The tabletop assembly 14 is configured to support electronic devices, such as the illustrated displays 22 and other user input/output devices (not shown) such as a keyboard, a mouse, a microphone, a speaker, etc. As explained in further detail below, the workstation 10 also includes a cable containment system, generally indicated at 25, which conceals and contains the power and signal cables for the electronic devices of the workstation in both the standing position and the sitting position. The routing of cables through the cable containment system 25 will be described in detail below and generally understood by those having ordinary skill in the art, but for clarity the cables are not shown in the drawings.

Figure 9:
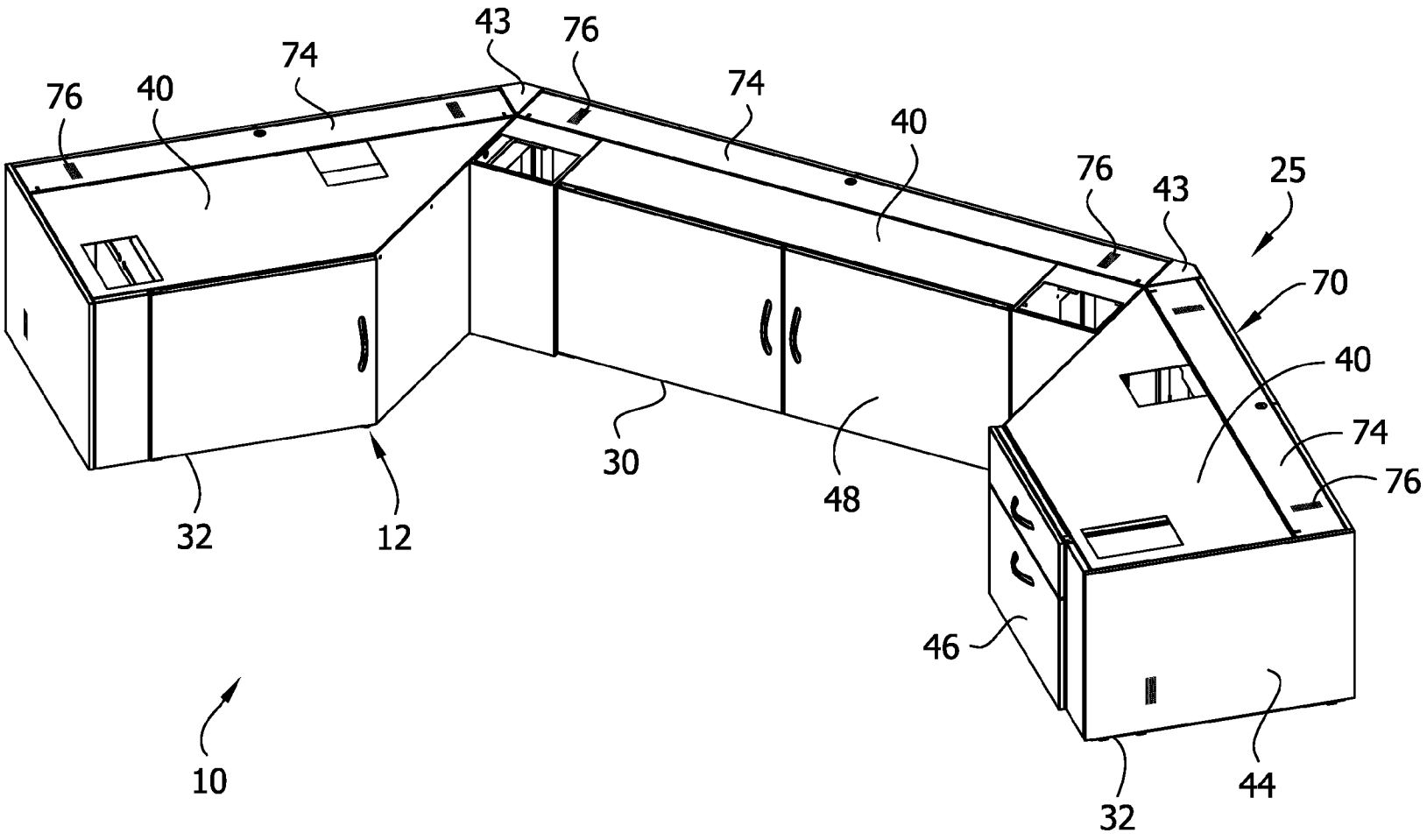
FIG. 9 is a perspective of the workstation with the tabletop assembly removed.
Figure 10:
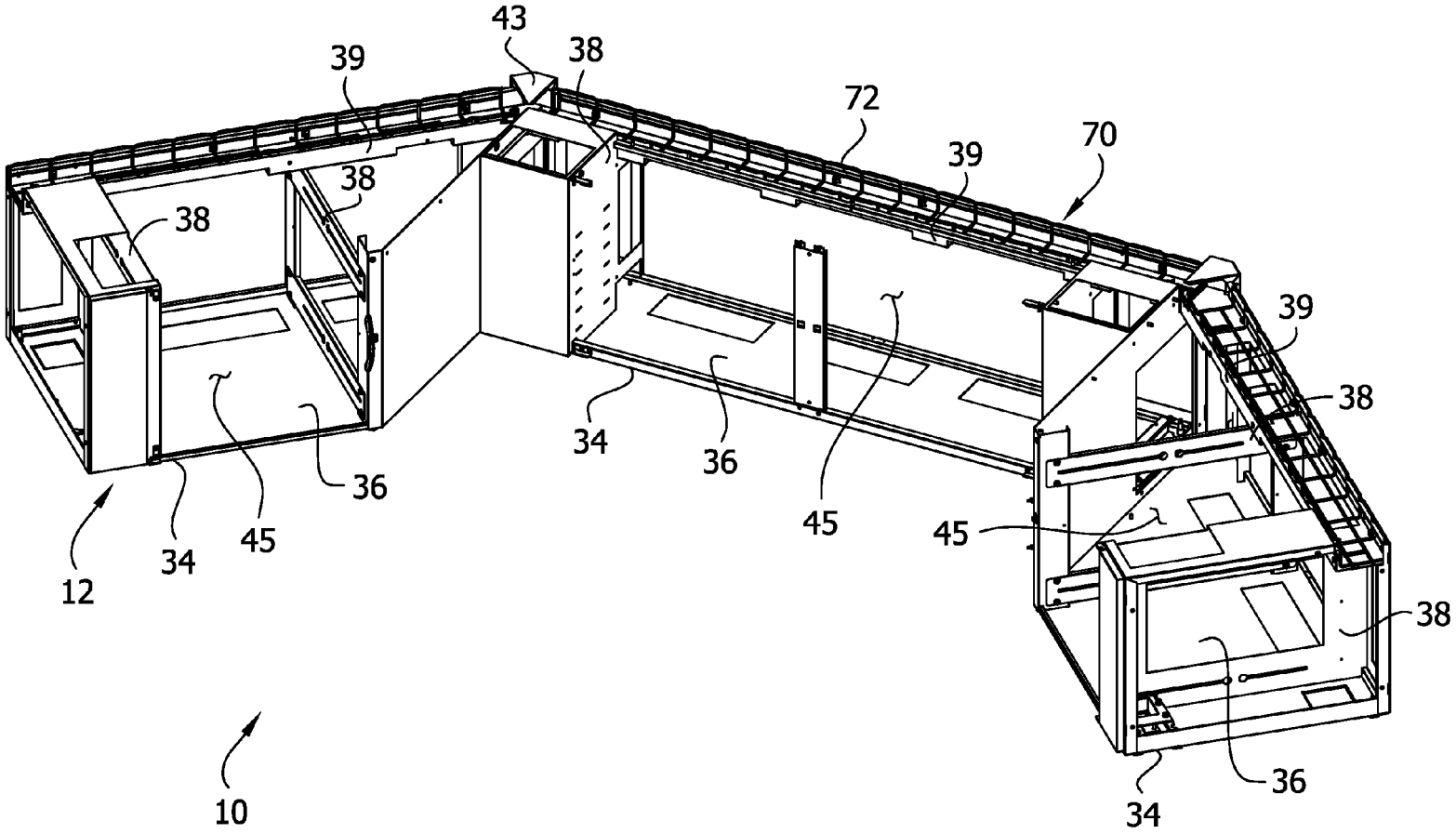
FIG. 10 is similar to FIG. 9 with exterior panels removed to illustrate a modular cabinet framework.

Referring to FIGS. 9 and 10, the modular base assembly 12 includes a plurality of cabinet modules 30, 32 that are arranged side-by-side to form the base assembly of the workstation 10. In the illustrated embodiment, the base assembly 12 includes one center cabinet module 30 and two side cabinet modules 32. Each of the cabinet modules 30, 32 has a width extending between opposite sides of the cabinet module, a depth extending from front to rear ends of the cabinet module, and a height extending from a bottom to a top of the cabinet module. The inboard side portion of each side cabinet module 32 is fastened to a respective side portion of the center cabinet module 30. In the illustrated embodiment, the inner side of each side cabinet module 32 is oriented at about a 45° angle relative to the width of the respective cabinet module and the sides of the center cabinet module 30 are oriented at about 90° angles relative to the width of the center cabinet module. Thus, since the cabinet modules 30, 32 are arranged side-by-side to form the base assembly 12, the width of each side cabinet module 32 is oriented at about a 45° angle relative to the width of the center cabinet module 30, and the widths of the two side cabinet modules are oriented at about a 90° angle relative to one another. In the illustrated embodiment, the center cabinet module 30 has a shallower depth than the side cabinet modules 32. As explained below, the shallow depth of the center cabinet module 30 allows a portion of the work platform 20 to overhang the legs of a user in the sitting position. Although the illustrated modular base assembly 12 is formed from three cabinet modules 30, 32 that are arranged side-by-side at 45° angles to the adjacent cabinets, other cabinet modules can be used to form modular base assemblies of other sizes, shapes, and arrangements in other embodiments. Thus, the base assembly can be selectively configured to suit the functional and/or spatial constraints of a given workstation by selecting from cabinet modules of different sizes and shapes and assembling them together in the desired manner.

As shown in FIG. 10, each cabinet module 30, 32 includes a framework 34 providing structural support to the module. Each illustrated framework 34 includes a bottom frame assembly 36, opposite side frame assemblies 38 secured to the bottom frame assembly, and an upper rear brace 39 extending between the opposite side frame assemblies. The side portions of each framework 34 are suitably configured for being fastened to another framework to thereby connect one cabinet module 30, 32 to another. For example, the side frame assemblies 38, the side portions of the bottom frame assemblies 36, and/or the side portions of the rear braces 39 may have pre-drilled holes or other preassembled attachment structures for connecting one framework to another with separate attachment hardware, such as bolts. Each side frame assembly 38 extends upward from the bottom frame assembly 36 toward the top of the respective cabinet module 30, 32. The rear braces 39 are secured to upper end portions of the side frame assemblies 38. As explained below, in the illustrated embodiment each rear brace 39 has a concave cross section that defines a channel configured to receive a portion of the cable containment system 27 therein. Thus, the rear braces 39 also constitute a cable containment support configured to support the cable containment system in the base assembly 12. The cable containment support 39 may be configured to support the cable containment system and not the corresponding cabinet module 30, 32.

The cabinet frameworks 34 are configured to support various features of the workstation 10 and are selectively configurable in many possible storage configurations. As shown in FIGS. 5 and 7-9, top panels 40, rear panels 42, rear joint covers 43, and side panels 44 are configured to be mounted on the frameworks 34 of the cabinet modules 30, 32 for enclosing an interior extending between the opposite sides of the base assembly 12. Suitably, the panels 40, 42, 44 and the joint covers 43 may be removably mounted on the frameworks 34 to allow selective access to the interior of the base assembly 12 for wiring electronic devices at the workstation 10, etc. Each framework 34 defines a storage area 45 (FIG. 10) extending widthwise between the respective side frame assemblies 38. The side frame assemblies 38 are configured to operatively mount drawers 46 and/or shelves (not shown) within the storage areas 45. In addition, cabinet doors may 48 may be mounted on the side frame assemblies 38 to enclose the storage areas 45. In the illustrated embodiment, the right side cabinet module 32 (the term "right" refers to the orientation of the base assembly 12 as shown in the front and top views of FIGS. 4 and 6) is configured as a two-drawer cabinet, the left side cabinet module (the term "left" refers to the orientation of the base assembly 12 as shown in the front and top views of FIGS. 4 and 6) is configured as a one-door cabinet, and the center cabinet module 30 is configured as a two-door cabinet. It will be understood that user could select different storage components and features for the cabinet modules 30, 32 in other embodiments.

Figure 6:
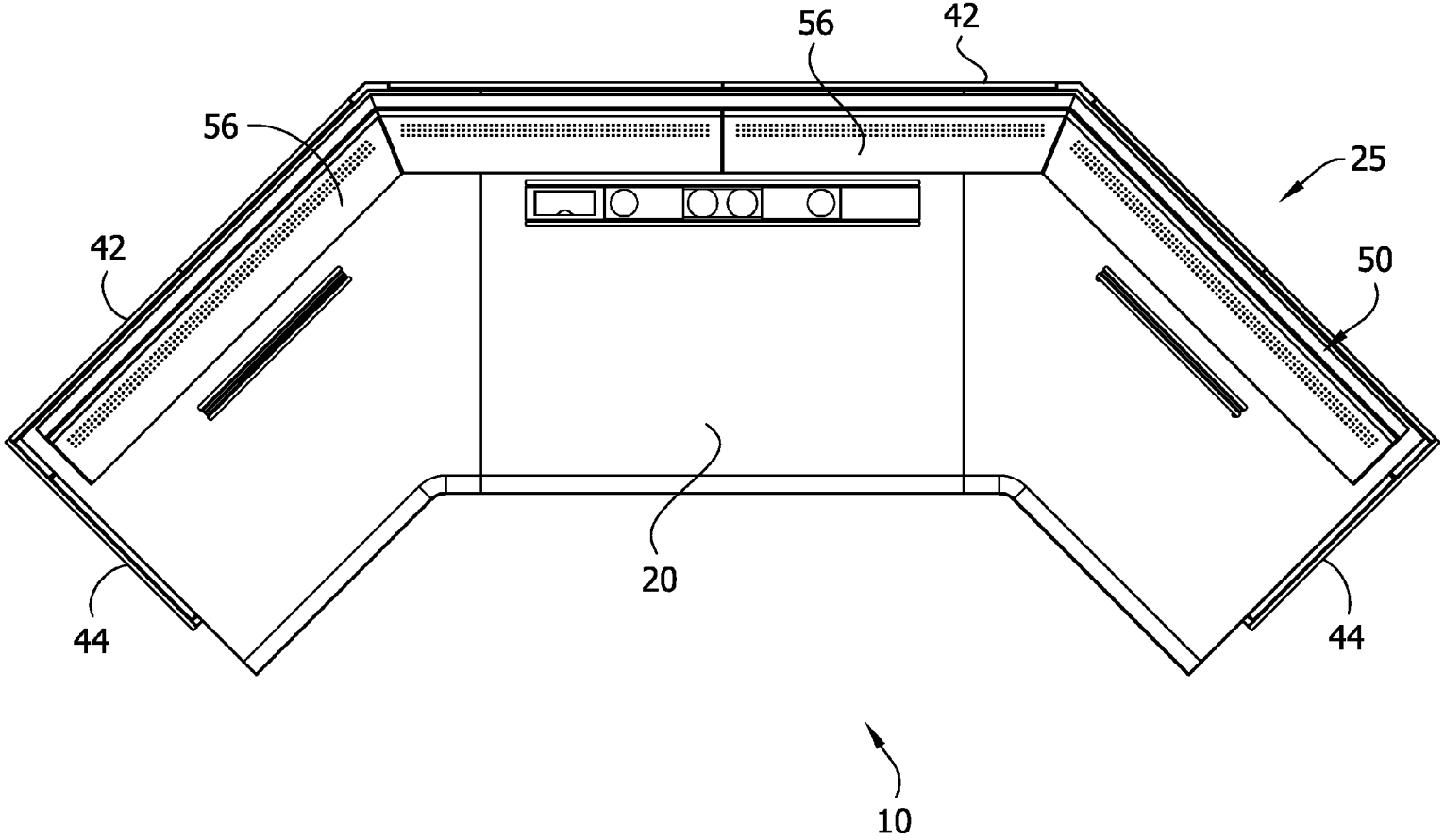
FIG. 6 is a top plan view of the workstation shown in FIG. 3.
Figure 7:
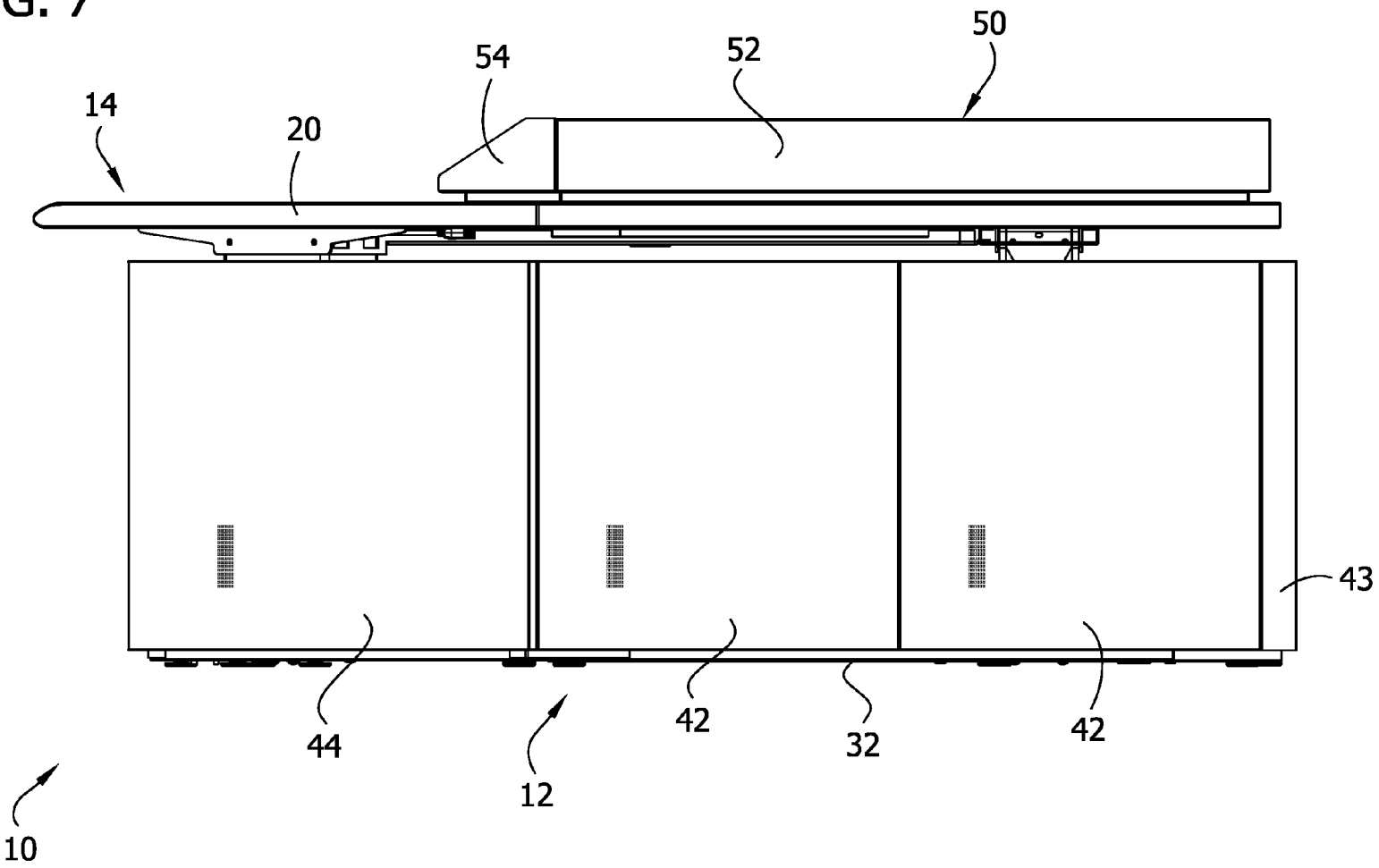
FIG. 7 is a right side elevation of the workstation shown in FIG. 3.
Figure 8:
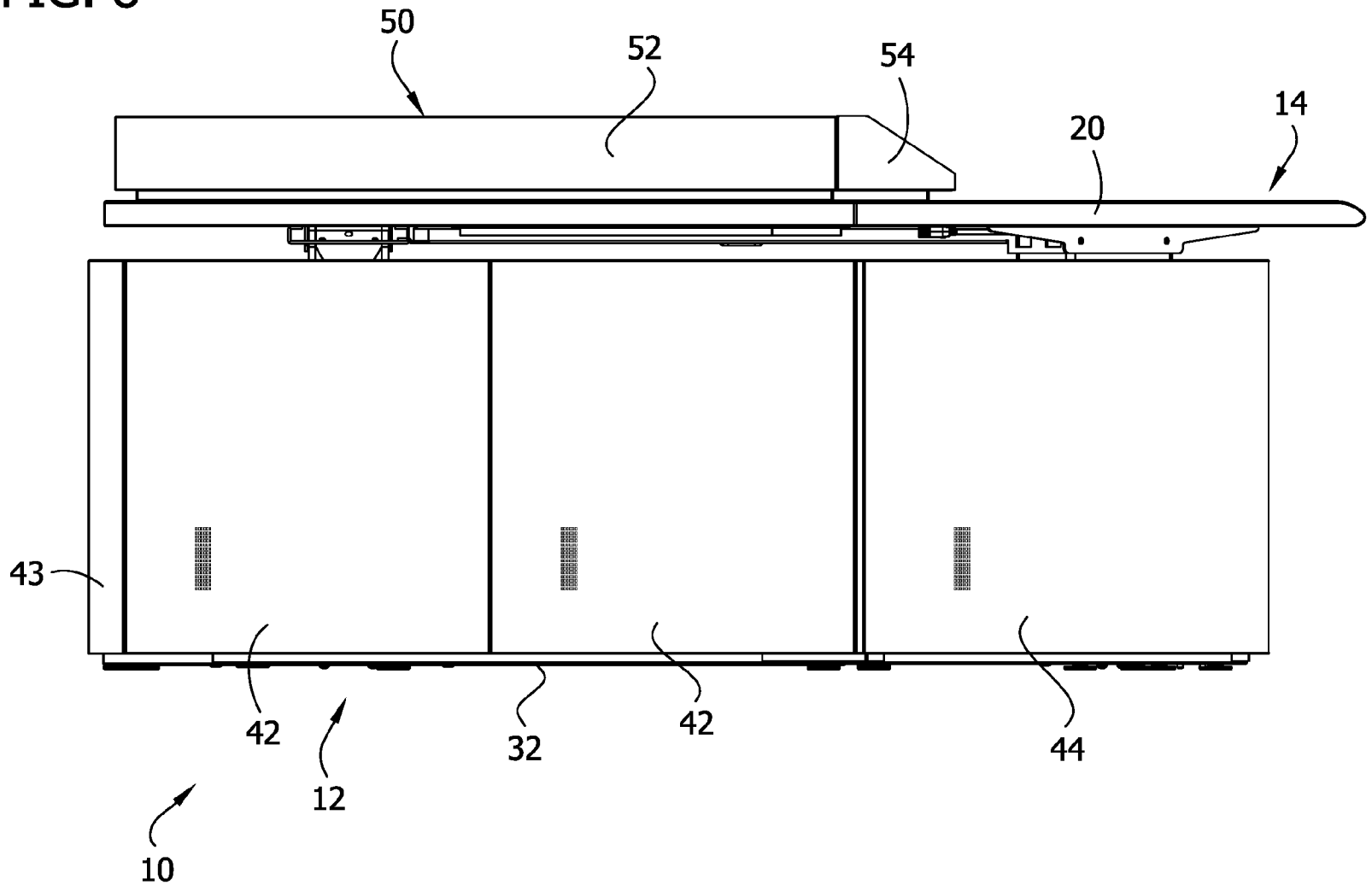
FIG. 8 is a left side elevation of the workstation shown in FIG. 3.

Referring to FIG. 6, the side and rear edges of the work platform 20 of the tabletop assembly 14 generally overlie the respective side and rear edges of the modular base assembly. Moreover, the side and rear edges of the work platform 20 of the tabletop assembly 14 have sizes and shapes that generally conform to the sizes and shapes of the side and rear edges of the modular base assembly 12 (e.g., a size and shape that generally lies within the footprint of the sides and rear of the modular base assembly). The work platform 20 has a center portion and first and second side portions extending outward from the sides of the center portion at about 45° angles. The rear edge of the work platform 20 is located slightly inboard of the rear panels 42 of the base assembly 12 (e.g., the rear edge of the work platform 20 is spaced apart inboard of the rear of the base assembly by less than about 1.5 inches) and extends generally parallel to the rear panels. Similarly, the side edges of the work platform 20 are located slightly inboard of the side panels 44 of the base assembly 12 (e.g., the side edges of the work platform 20 are spaced apart inboard of the sides of the base assembly by less than about 1.5 inches) and extend generally parallel to the side panels. A front edge portion of the work platform extends forward past the ends of the cabinet modules 30, 32 to define an overhang under which the legs of a user may be positioned while seated.

Figure 11:
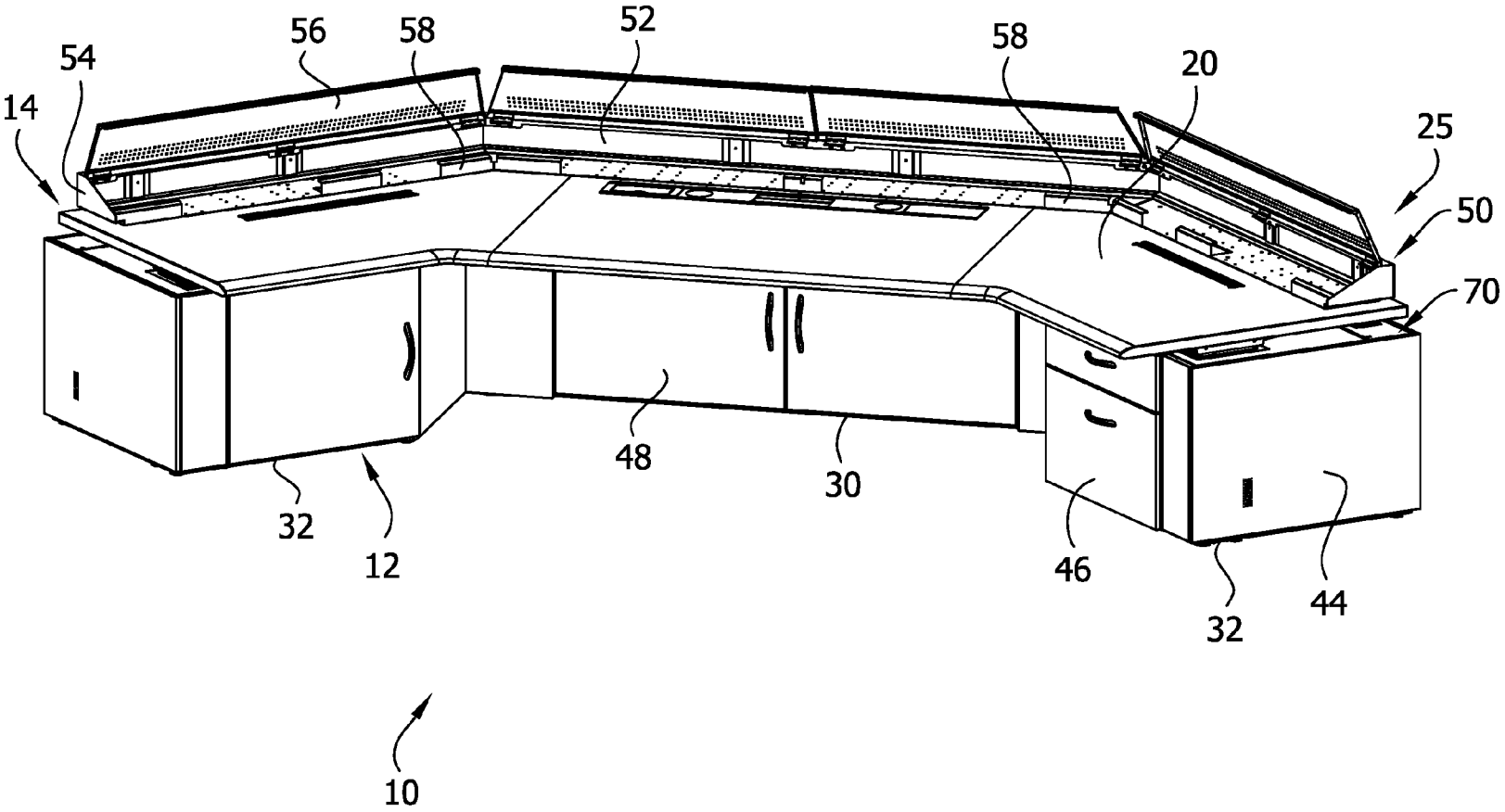
FIG. 11 is similar to FIG. 3 with a tabletop cable enclosure shown in an open position.
Figure 12:
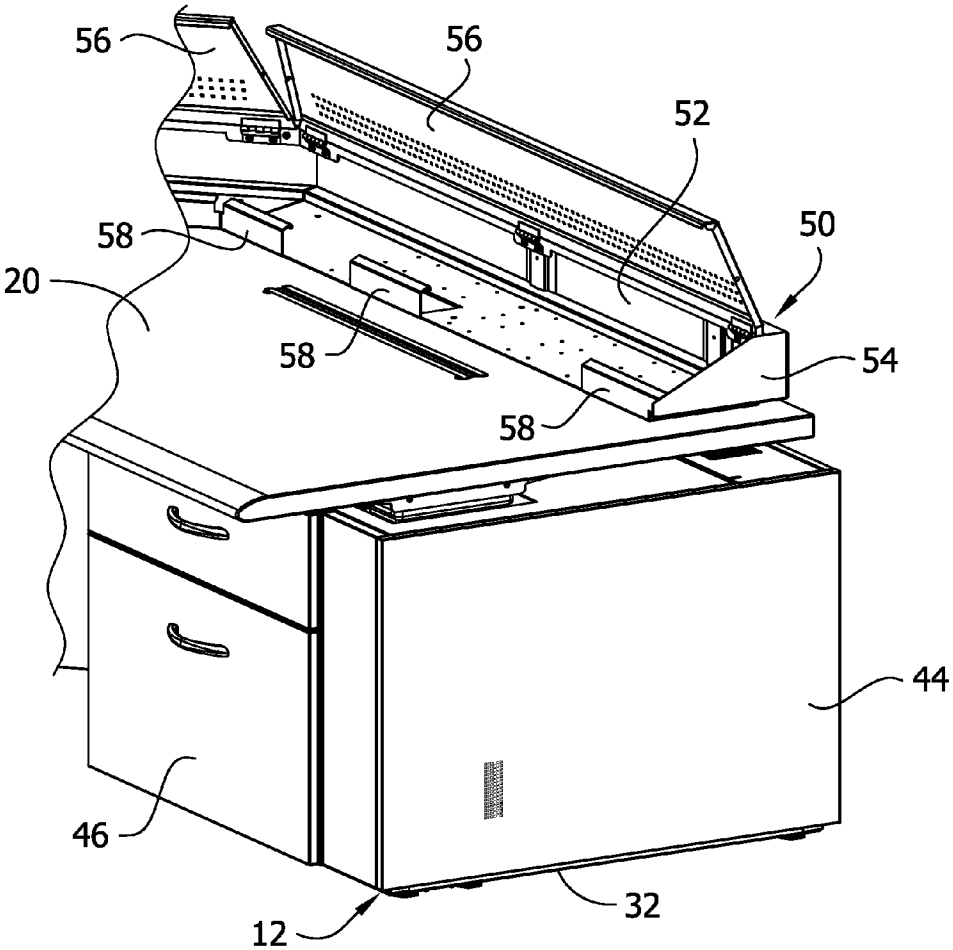
FIG. 12 is an enlarged view of a portion of the workstation shown in FIG. 11.
Figure 13:
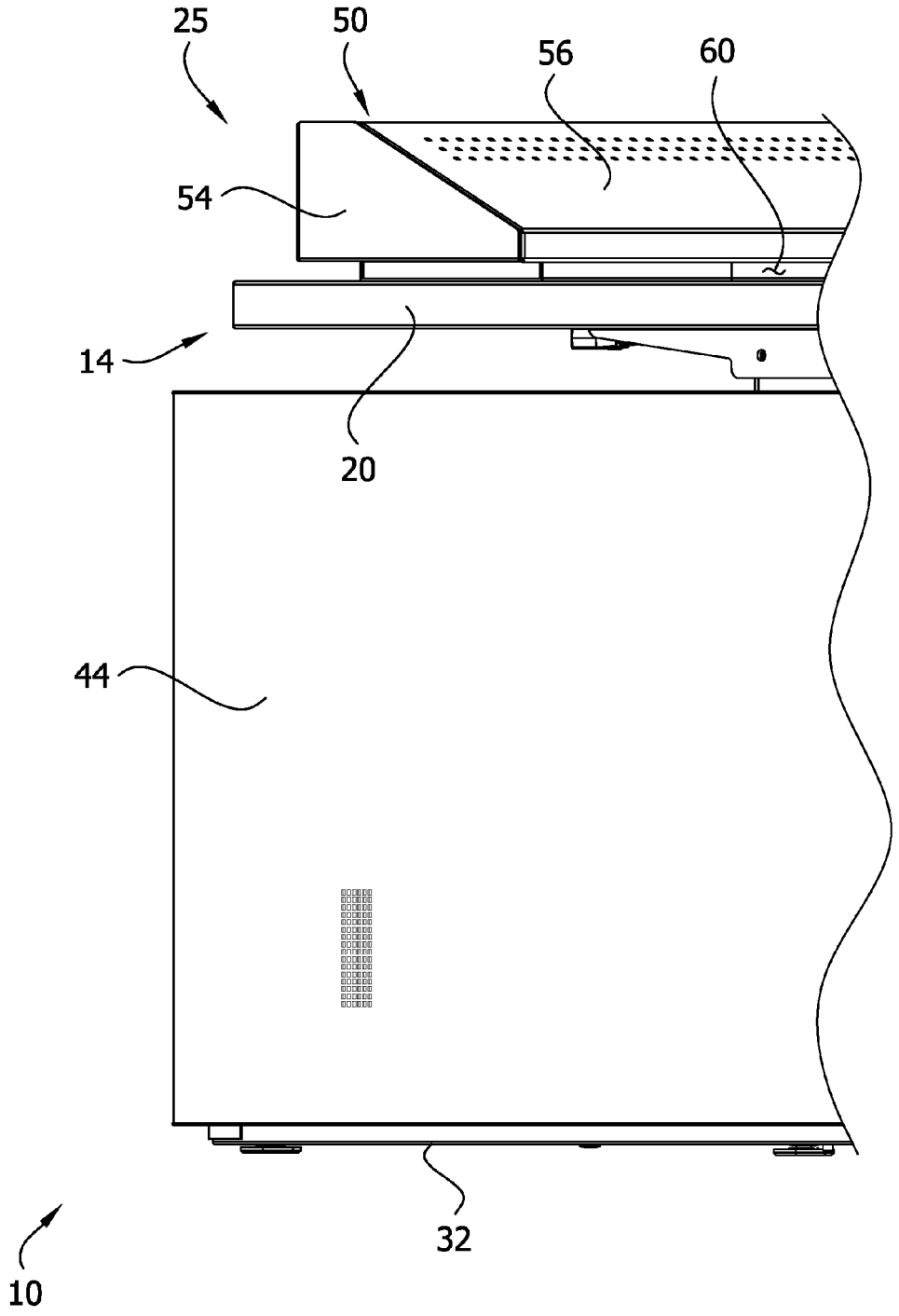
FIG. 13 is an enlarged view of a portion of the workstation shown in FIG. 8.

Referring to FIGS. 11-13, the cable containment system 25 includes a tabletop cable enclosure or raceway, generally indicated at 50, which is mounted on the tabletop assembly 14 for movement with the tabletop assembly between the sitting and standing positions. As shown best in FIG. 12, the tabletop cable enclosure 50 includes a rear wall 52, left and right side walls 54, and four cover members 56 pivotably secured to the rear wall. Together, the rear wall 52, the side walls 54, the cover members 56, and the rear end portion of the work platform 20 define a substantially open interior of the enclosure 50. Tabletop cable enclosures having other configurations may also be used in other embodiments. The cover members 56 of the tabletop cable enclosure 50 are selectively pivotable relative to the rear wall 52 between a closed position (FIG. 3) and an open position (FIG. 11). In the closed position, the front end portions of the cover members 56 rest on front stops 58 of the enclosure 50 that extend upward from the work platform 20. As shown in FIG. 12, the stops 58 engage the front end portions of the cover members 56 in the closed position and position the front end portions of the cover members so that they are spaced apart from the work platform 20 to define openings or gaps 60 between the cover members and the work platform. The gaps 60 allow cables to pass from displays 22 and other user input/output devices on the tabletop assembly 14 into the interior of the cable enclosure 50 when it is closed. In the illustrated embodiment, ventilation holes are formed in each cover member 56 to prevent overheating of the cables within the enclosure interior.

The enclosure 50 is configured to conceal and route cables extending into the interior of the enclosure through the gaps 60 along the rear end portion of the tabletop assembly 14 and downward toward the interior of the modular base assembly 12. In one or more embodiments, power and/or signal receptacles or connectors (not shown) are permanently mounted on the enclosure 50 (e.g., on the interior of the rear wall 50 or on the rear end portion of the work platform 20). The source cables for the pre-installed receptacles and connectors may be routed into the base assembly 12 through cable chain assemblies 62 (FIG. 2) as described below. Cables that are not connected to pre-installed connectors in the enclosure 50 may be routed horizontally through the interior of the enclosure to holes 62 extending through the work platform 20. Suitably, the holes 62 are aligned with the cable chain assemblies 64, as shown in FIG. 2. The cables extend through the cable chain assemblies 64 and into the interior of the modular base assembly 12 as explained below. The cable chain assemblies 64 receive segments of the cables that are long enough to accommodate movement of the tabletop assembly 14 between the sitting position and the standing position. As is generally known in the art, the cable chain assemblies 64 are configured to fold the received cable segments into compact configurations that fit beneath the tabletop assembly 14 in the sitting position. The cable chain assemblies 64 are also configured to straighten the cable segments when the tabletop assembly 14 is moved to the standing position.

Figure 14:
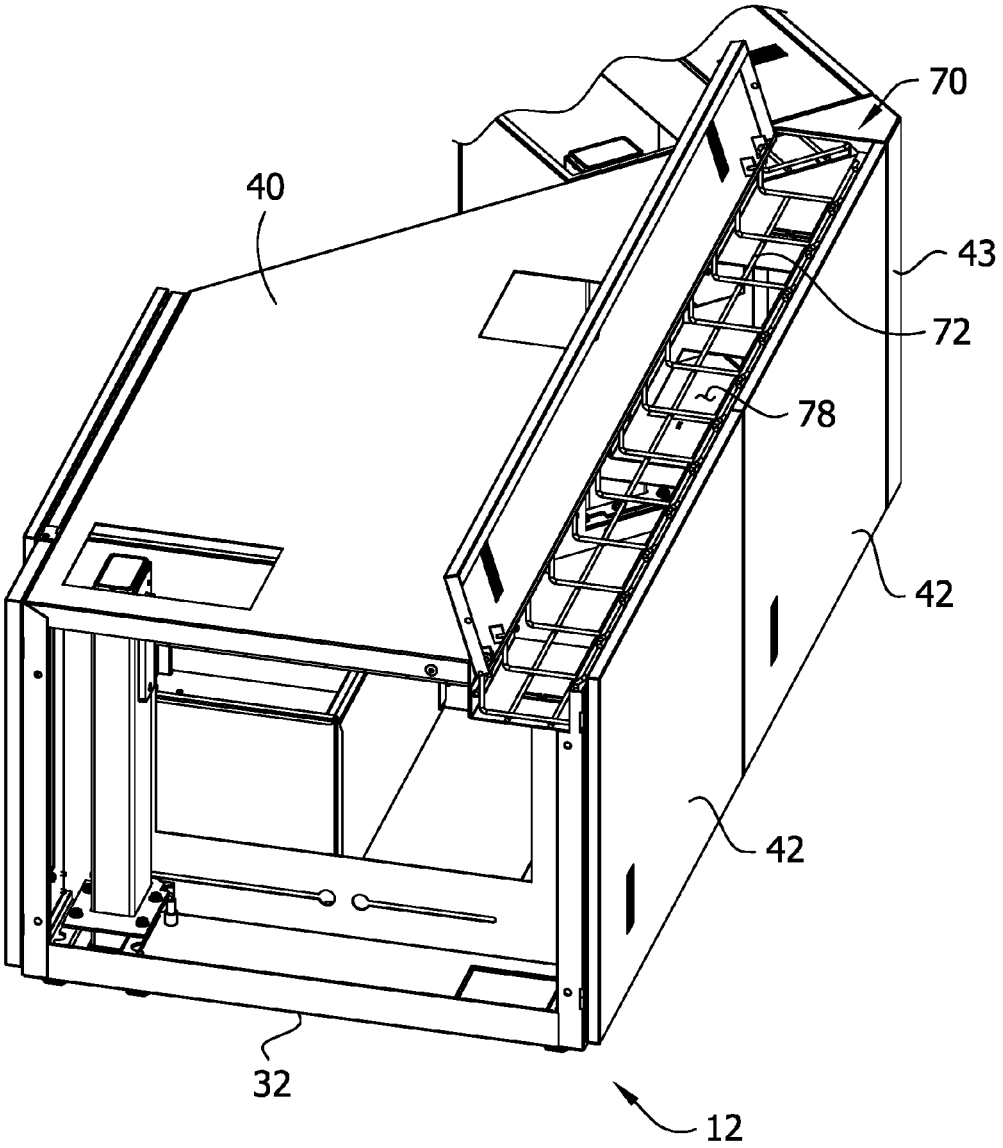
FIG. 14 is an enlarged, fragmentary perspective of a portion of the workstation with the tabletop assembly and a cover of an interior cable raceway removed to reveal a wire basket.

Referring to FIGS. 9, 10, and 14, an interior cable raceway, generally indicated at 70, is mounted on the frames 34 of the cabinets 30, 32 within the interior of the base assembly 12. The interior cable raceway 70 includes an elongate wire basket 72 (broadly, a raceway segment) mounted on each cabinet module 30, 32, and corresponding covers 74. In the illustrated embodiment, each wire basket 72 extends along the width of the respective cabinet module 30, 32 at the upper rear portion of the framework 34. More specifically, each wire basket 72 is mounted within the channel defined by the concave rear brace 39 of the respective cabinet module 30, 32. Interior cable raceways 70 may be installed at other locations within the cabinet modules in other embodiments. Cables from the cable chain assemblies 64 may be routed into the wire baskets 72 through the openings (FIG. 14) in the bottom or sides of the baskets. Upper surfaces of the covers 74 are generally coplanar with the upper surfaces of the top panels 40 of the modules 30, 32 to give an integral look to the modules. In the illustrated embodiment, the covers 74 are pivotable relative to the corresponding wire baskets 72 and the work platform 20 to open the covers, to provide access to an interior channel 78 (FIG. 14) of the raceway 70, and close the covers, the contain the cables therein. Alternatively, or in addition, the covers 74 may be removable from the base assembly 12 during installation of the cables to provide substantially open access to the interior channel 78 of the raceway 70. In some embodiments, the cover panels 74 are pivotably mounted on the cabinet modules 30, 32 by hinged retainers (not shown). The hinged retainers may guide pivoting movement of the cover panels 74 relative to the cabinet modules 30, 32 about a pivot axis through a range of motion. Furthermore, the hinged retainers may be configured to allow the cover panels 74 to be fully removed by moving the cover radially outward of the pivot axis while the cover panel is oriented at a specified pivot angle. The retainers may be configured to prevent the cover panels 74 from being removed when oriented at other angles in the range of motion besides the specified pivot angle. The interior cable raceway 70 may include one or more locks to selectively inhibit opening of the covers 74 to provide added security.

Each wire basket 72 is mounted on the respective cabinet 30, 32 near the top rear corners of the side frame assemblies 38. As explained above, the wire baskets 72 are received in the channels defined by the concave rear braces 39 of the frameworks 34. Any suitable fastener, locking mechanism, or retaining structure may be used to secure the wire basket 72 to the respective framework 34. Suitably, the wire basket 72 may be removably mounted on the respective framework 34. When the frameworks 34 are fastened together in side-by-side arrangement with one another, the wire baskets 72 align to form a substantially continuous cable raceway channel 78 extending along the rear end portion of the base assembly 12. That is, each of the rear braces 39 extends horizontally through the respective cabinet module 30, 32 and is positioned at about the same position in the respective cabinet module (e.g., at about the same height and about the same depth). Thus, the frameworks 34 operatively align the wire baskets 72 whenever the wire baskets are mounted on the frameworks and the cabinet modules 30, 32 are fastened together using the prefabricated attachment structures as discussed above. It can be seen that one or more additional cabinet modules comprising a wire basket or cable raceway segment mounted on a framework could be fastened to the illustrated side cabinet modules 32 using prefabricated attachment structures. When the additional cabinet modules are properly connected to the side cabinet modules 32 the additional wire baskets would align with the illustrated wire baskets 72 to increase the overall length of the cable raceway 70. Thus the modular cabinets used to form the base assembly 12 may be combined in various configurations to form a cable raceway having a length that is suitable for the needs of a given user.

In one embodiment, the cable chain assemblies 64 extend through openings in the tops of the cabinet modules 30, 32 to route the cables into the interior of the base assembly 12. The cables are routed from the lower end portions of the cable chain assemblies 64 into the interior of the base assembly 12' through openings in the wire baskets 72' and into the cable raceway channel 78. The cables are then routed horizontally through the wire baskets 72 to respective exit points. Because the bottoms of the wire baskets 72 include the openings along their lengths, the cables can exit the cable raceway channel 78 at essentially any point along the width of the base assembly 12. Thus, cables can exit the cable raceway channel 78 at respective exit points that are proximate a source receptacle or connector for the respective cable. For example, a signal cable may exit a raceway at a location near a source computer (e.g., a rack-mounted computer within the interior of the base assembly) or the like. Likewise, a power cable may be routed out of the wire baskets 72 at an exit location adjacent a power receptacle. It will be understood that cables may also be routed from the wire baskets 72 to receptacles or connectors located remote from the workstation 10.

In one or more embodiments, the modular base assembly 12 includes a secondary interior cable raceway (not shown) that is spaced apart from the primary interior cable raceway 30. For example, the rear end portions of the second frameworks may be shaped and arranged to define channels for receiving the secondary raceway near the bottom of the base assembly 12. In certain embodiments, a wire basket or other cable guide is mounted on the lower, rear portion of each framework 34 so that the cabinet modules 30, 32 define a substantially continuous secondary raceway channel along the rear of the base assembly 12 when fastened together as explained above in reference to the interior raceway 70. The primary and secondary raceways may be used to separately route different kinds of cables through the interior of the base assembly 12 to physically separate the cables and thereby limit electrical interference.

As can be seen, the illustrated workstation 10 provides a vertically adjustable work platform 20 on a base assembly 12 with configurable storage features. The tabletop assembly 14 is sized to generally correspond to the footprint of the base assembly 12, which may minimize pinch points of the device when the elevation of the work platform 20 is adjusted. Moreover, the work station 10 provides integrated cable management that conceals and organizes cables for worktop mounted electronic equipment, while allowing the electronic equipment to move vertically with the work platform 20 between the standing and sitting positions. The tabletop cable enclosure 50 organizes and conceals the portions of the cables that travel with the work platform 20, and the cable chains 64 contain the portions of the cables extending between the movable tabletop assembly 14 and the stationary base assembly 12. The interior cable raceway 70 routes stationary portions of the cables through the interior of the base assembly 12, and the base assembly conceals the cables. Each cable may be routed out of the interior cable raceway 70 at an exit location near the source receptacle or connector. When desired, the workstation 10 may also be configured to include a secondary interior cable raceway for maintaining physical separation between cables that could interfere with one another.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A height-adjustable work station comprising:

a base assembly comprising a center cabinet module, a left cabinet module secured to a left side of the center cabinet module, and a right cabinet module secured to a right side of the center cabinet module, the base assembly having an upper surface, opposite left and right sides defining a width of the base assembly extending therebetween, and opposite front and rear ends defining a depth of the base assembly therebetween, wherein the upper surface of the base assembly has left, right, front and rear edges at the junctions of the left side, right side, front end and rear end, respectively, a work platform disposed above the base assembly, the work platform having a lower surface in generally opposing relationship with the upper surface of the base assembly, opposite left and right sides defining a width of the work platform extending therebetween, and opposite front and rear ends defining a depth of the work platform therebetween, wherein the lower surface of the work platform has left, right, front and rear edges at the junctions of the left side, right side, front end and rear end, respectively; and a lift operatively connected to the work platform and configured to selectively adjust an elevation of the work platform above the base assembly, wherein the left, right and rear edges of the lower surface of the work platform generally overlie the left, right and rear edges, respectively, of the upper surface of the base assembly, wherein sizes and shapes of the left, right and rear edges of the lower surface of the work platform generally conform to the sizes and shapes of the left, right and rear edges, respectively, of the upper surface of the base assembly, wherein each of the center, left, and right cabinet modules comprises opposite first and second side walls, a front, a back, a side frame running from the front to the back and disposed between the opposite first and second side walls, a storage area disposed between the first side wall and the side frame, and a lift-receiving area disposed between the second side wall and the side frame, wherein a storage component is received in the storage area, wherein the lift is received in the lift-receiving areas of the center, left, and right cabinet modules and extends upward therefrom through openings in the upper surface of the base assembly.

2. The height-adjustable work station set forth in claim 1, wherein the rear edge of the lower surface of the work platform is slightly inboard of the rear edge of the upper surface of the base assembly.

3. The height-adjustable work station set forth in claim 2, wherein the rear edge of the lower surface of the work platform is parallel to the rear edge of the upper surface of the base assembly.

4. The height-adjustable work station set forth in claim 2, wherein the left edge of the lower surface of the work platform is slightly inboard of the left edge of the upper surface of the base assembly, wherein the right edge of the lower surface of the work platform is slightly inboard of the right edge of the upper surface of the base assembly.

5. The height-adjustable work station set forth in claim 4, wherein the left edge of the lower surface of the work platform is parallel to the left edge of the upper surface of the base assembly, wherein the right edge of the lower surface of the work platform is parallel to the right edge of the upper surface of the base assembly.

6. The height-adjustable work station set forth in claim 4, wherein the front edge of the lower surface of the work platform overhangs the front edge of the upper surface of the base assembly.

7. The height-adjustable work station set forth in claim 1, wherein the left edge of the lower surface of the work platform is slightly inboard of the left edge of the upper surface of the base assembly, wherein the right edge of the lower surface of the work platform is slightly inboard of the right edge of the upper surface of the base assembly.

8. The height-adjustable work station set forth in claim 1, wherein the depth of the center cabinet module is less than the depth of the left and right cabinet modules.

9. The height-adjustable work station set forth in claim 1, further comprising a cable containment enclosure mounted on the work platform and extending adjacent the rear end of the work platform.

10. The height-adjustable work station set forth in claim 1, further comprising a cable raceway secured to the base assembly, the cable raceway including a wire basket received inside the base assembly and configured to receive cables therein, and a cover secured to the base assembly and configurable between being open, in which the wire basket is accessible through the upper surface of the base assembly, and closed, in which the cover inhibits access to the wire basket through the upper surface of the base assembly.

11. A work station comprising:

a base assembly including sides having upper and lower ends, and an upper surface at the upper end of the sides and defining an access opening, wherein the sides and the upper surface define an interior of the base assembly;

a cable raceway secured to the base assembly adjacent the access opening defined by the upper surface of the base assembly, the cable raceway including a basket disposed in the interior of the base assembly, the basket having an open upper end adjacent the access opening, and a bottom end defining a plurality of openings, the basket configured to receive cables therein, and a cover configured to be movable relative to the upper surface of the base assembly between a closed position, in which the cover is received in the access opening and covers the open upper end of the basket to inhibit access to the basket through the access opening, and an open position, in which the cover is at least partially outside the access opening to allow access to the basket through the access opening; and a work platform disposed above the upper surface of the base assembly and above the cover.

12. The work station set forth in claim 11, wherein the cover has an upper surface that is generally coplanar with the upper surface of the base assembly when the cover is in the closed position.

13. The work station set forth in claim 12, wherein the cover is selectively pivotable about a pivot axis relative to the basket and the base assembly to move the cover between the open and closed positions.

14. The work station set forth in claim 13, wherein the cover is selectively removable from the base assembly.

15. The work station set forth in claim 11, wherein the cover is pivotably secured to the base assembly.

16. The work station set forth in claim 11, wherein the basket comprises a wire basket.

17. The work station set forth in claim 11, further comprising a lift operatively connected to the work platform and configured to selectively adjust an elevation of the work platform above the base assembly.

18. The work station set forth in claim 11, wherein the base assembly comprises a plurality of cabinet modules secured to one another, each cabinet modules having an upper surface defining a portion of the upper surface of the base assembly, and an access opening defining a portion of the access opening of the base assembly, wherein the basket comprises a plurality of baskets each of which being received in one of the cabinet modules, wherein the cover comprises a plurality of covers each of which is associated with one of the baskets.

19. The work station as set forth in claim 11 wherein the work platform has an upper surface, and further comprising an exterior cable raceway mounted to the upper surface, the exterior cable raceway including a plurality of walls, wherein the walls define a substantially open interior portion, and at least one wall defines an access opening; and wherein the work platform defines a plurality of openings into the exterior cable raceway.

20. The work station set forth in claim 11, further comprising a cable containment enclosure mounted on the work platform adjacent a rear end of the work platform.

* * * * *